United States Patent [19]

Pahnke

[11] Patent Number: 4,745,793

[45] Date of Patent: May 24, 1988

[54] HYDRAULICALLY DRIVEN FORGING MACHINE

[75] Inventor: Hans J. Pahnke, Düsseldorf, Fed. Rep. of Germany

[73] Assignee: Pahnke Engineering GmbH & Co. KG, Dusseldorf, Fed. Rep. of Germany

[21] Appl. No.: 18,407

[22] Filed: Feb. 25, 1987

[30] Foreign Application Priority Data

Mar. 8, 1986 [DE] Fed. Rep. of Germany ..... 3607737

[51] Int. Cl.[4] ..... B21J 7/14

[52] U.S. Cl. ..... 72/402; 72/399; 72/453.01; 72/453.08; 72/76

[58] Field of Search ..... 72/399, 402, 403, 407, 72/444, 76, 453.01, 453.08

[56] References Cited

U.S. PATENT DOCUMENTS

| | | | |
|---|---|---|---|
| 3,645,126 | 2/1972 | Kralowetz et al. | 72/402 |
| 3,681,966 | 8/1972 | Kralowetz et al. | 72/402 |
| 3,916,667 | 11/1975 | Paknke et al. | 72/402 |

FOREIGN PATENT DOCUMENTS

| | | | |
|---|---|---|---|
| 202134 | 11/1984 | Japan | 72/402 |

*Primary Examiner*—David Jones

*Attorney, Agent, or Firm*—Holman & Stern

[57] ABSTRACT

A hydraulically driven forging machine with four radially arranged working cylinders has piston pumps disposed as individual pumps about the forging machine with all pump-end pipe connections located on the horizontal center plane of the forging machine, so that all pipe conduits leading to the working cylinders are equal in length and as short as possible in order to equalize and minimize stroke volume losses in the four working cylinders which result from the compressibility of the fluid pressure medium.

2 Claims, 3 Drawing Sheets

HYDRAULICALLY DRIVEN FORGING MACHINE

BACKGROUND OF THE INVENTION

Field of the Invention

The invention relates to hydraulically driven forging machines having radially arranged working pistons in cylinders each of which is connected to a piston pump through a pipe conduit, the pumps being driven synchronously by mechanical or electrical means to synchronize the working pistons of the forging machine. It is common practice to combine the piston pumps to form a so-called crank-type driving apparatus, as shown for example in German publication DE-PS No. 23 06 566 corresponding to U.S. Pat. No. 3,916,667, having four driving pistons driven by a single crankshaft and a single driving motor. It has already been realized that oil leakage losses necessitate special measures to ensure absolute synchronism between the working pistons of the forging machine, i.e. at least for the power stroke of the pistons, by correcting the stroke position as shown in German publication DE-PS 22 07 717 and the literature cited therein, corresponding to U.S. Pat. No. 3,841,125.

The measures known according to the prior art for stroke position correction of the working cylinders of the forging machine require complex and involved apparatuses and control equipment and, if at all, give only insufficient account to the effect of unequally long pipe conduits between a crank type driving apparatus and the four working cylinders of the forging machine. That is to say, in the load condition of the forging machine, compression of the hydraulic fluid in the working cylinders, drive cylinders and pipe conduits will give rise to a stroke volume loss on the pistons of the working cylinders, which may total up to 50% of the theoretical power stroke.

With the solutions which have so far become known and which apply driving apparatuses spaced apart from the forging machine, the length of the pipe conduit is a factor as such, since a pipe conduit may accommodate the tenfold volume of the stroke volume of a working piston.

SUMMARY OF THE INVENTION

Therefore, in order to lessen the demands made on stroke position correction means (and to also eliminate leakage losses), the object of the invention is to minimize the stroke volume loss caused by the length of the pipework between the driving apparatus or piston pump and the associated working cylinder of the forging machine.

According to the invention, this problem is solved by arranging the four piston pumps about the forging machine as individual pumps in upright position in such a manner that all pump-end pipe connections will lie on the horizontal center plane of the forging machine. In this manner, mere positional allocation of the individual pumps, despite their being set up on a common foundation, will meet the condition for designing all pipe conduits leading to the working cylinders of the forging machine equally long and as short as possible.

Although radial distribution of the four working cylinders of a forging machine may also include the method of arranging the working cylinders on a vertical and a horizontal plane in pairs, an arrangement preferred in practice comprises pairs of working cylinders placed opposite each other on two intersecting sloping planes. In this particular case, the invention provides a method in which the piston pumps are located two by two in the vicinity of two working cylinders superimposed in the vertical projection. A pipe conduit will then extend from one piston pump of a pair of pumps slopingly upward to the upper working cylinder, while the conduit for the lower working cylinder will extend slopingly downward from the other pump. The two pipe conduits are equal in length, since the pump-end pipe connections are located on the horizontal center plane of the forging machine.

Although the present invention does not exclude the method of synchronizing the piston pump drives through an "electrical shaft", mechanical synchronization of the pump drives is preferred. Accordingly, the invention includes a common drive motor which is located on the vertical center plane of the forging machine in which the forging axes lie, and which is followed by a power distributing gear unit with two horizontally spaced output shafts, each being connected to two piston pumps through intermediate shaft insertions.

BRIEF DESCRIPTION OF THE DRAWING

The invention will now be described in detail with reference to an exemplary embodiment thereof illustrated in the accompanying drawing, wherein.

DETAILED DESCRIPTION OF THE INVENTION

Figure 1:
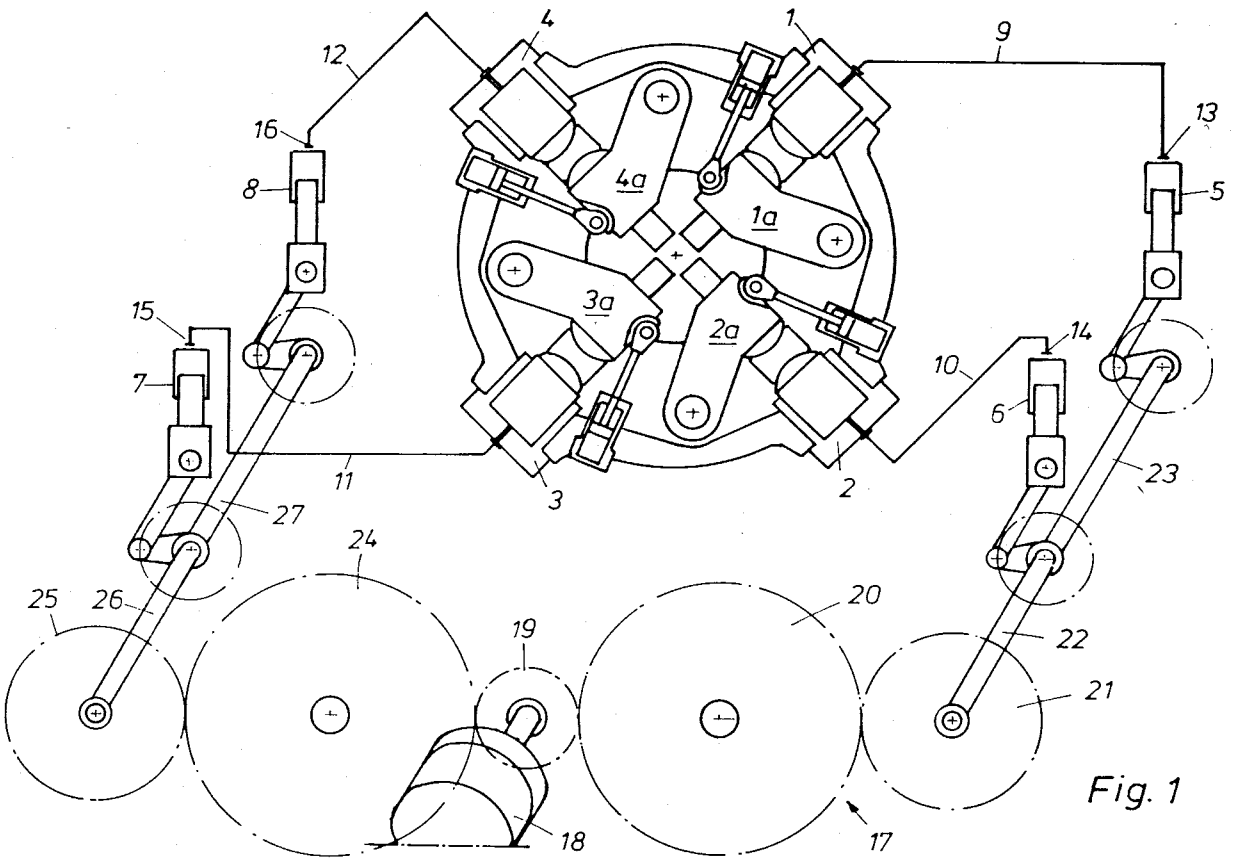
FIG. 1 is a diagrammatic view of the arrangement of four piston pumps with a common drive, in relation in accordance with the invention.

The forging machine shown in FIG. 1 comprises four working cylinders 1, 2, 3 and 4, pairs of which are located oppositely on two intersecting sloping planes, their pistons acting on pivotally mounted forging saddles 1*a*, 2*a*, 3*a* and 4*a*. As shown in the plan view in FIG. 2, two working cylinders at a time 4, 1 and 3, 2 are superposed in the vertical projection, which may also be taken from the side view in FIG. 3. In contrast, the schematic view in FIG. 1 shows the forging machine in a transposed position.

Among the four piston pumps 5, 6, 7 and 8 designed in upright position, pumps 5 and 8 are located in the immediate vicinity of working cylinders 4, 1 (FIG. 2), while piston pumps 6 and 7 are positionally allocated to the two working cylinders 3, 2. As most clearly shown in FIG. 1, the piston pumps are connected to the working cylinders 1 to 4 through pipe conduits 9, 10, 11 and 12 extending from pump-end pipe connections 13, 14, 15 and 16.

Figure 3:
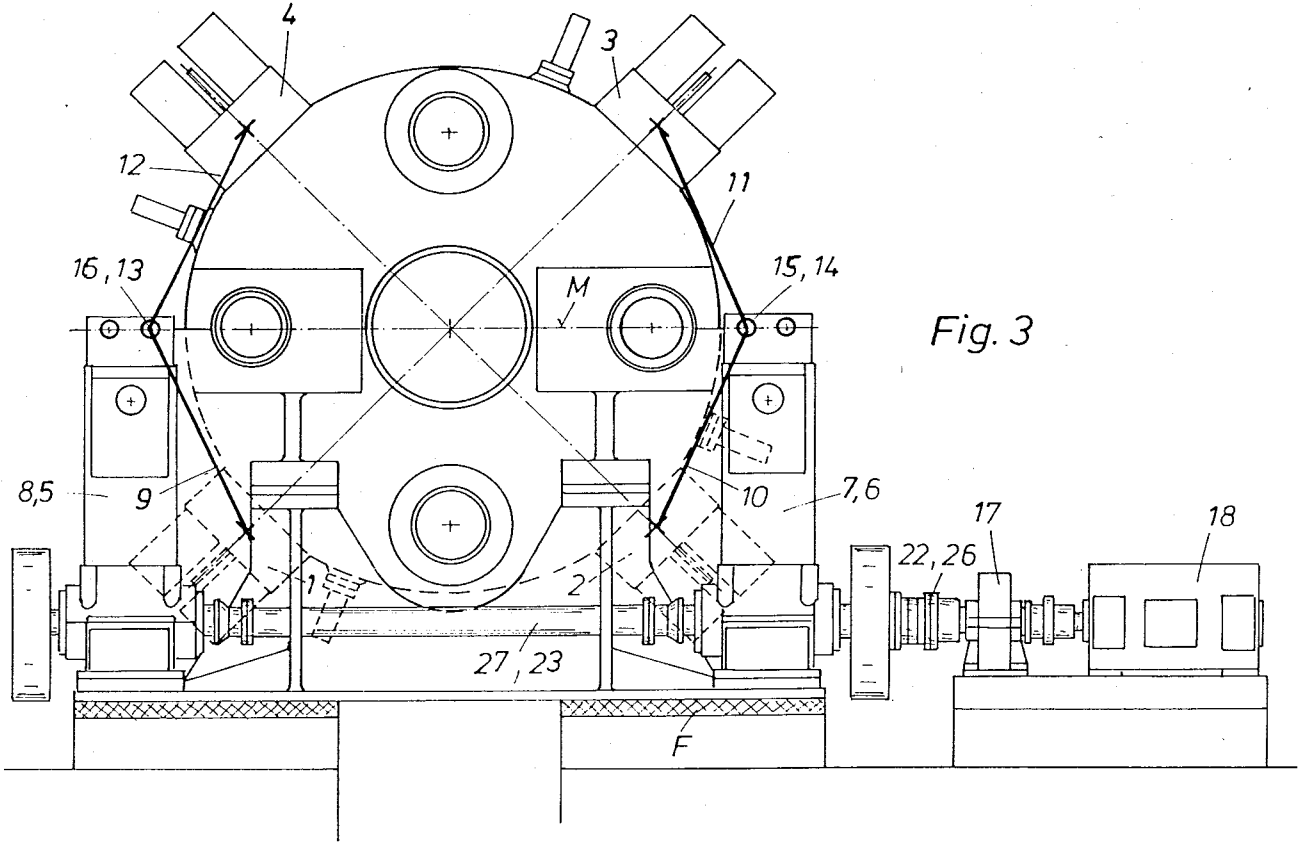
FIG. 3 is an elevational view of FIG. 2 taken in the direction of arrow A.

According to the side view in FIG. 3, the piston pumps 5 to 8 are mounted on a common foundation F on a level sufficiently low to permit their top-end pipe connections 16, 13 and 15, 14 to lie on the horizontal center plane M of the forging machine. The pipe conduits 9, 10, 11 and 12 leading to the working cylinders 1 to 4 are drawn in straight lines which clearly indicate that the symmetrical two-by-two arrangement of the working cylinders relative to the pump-end pipe connections permits the pipe conduits to be designed equally long and also optimally short.

Figure 2:
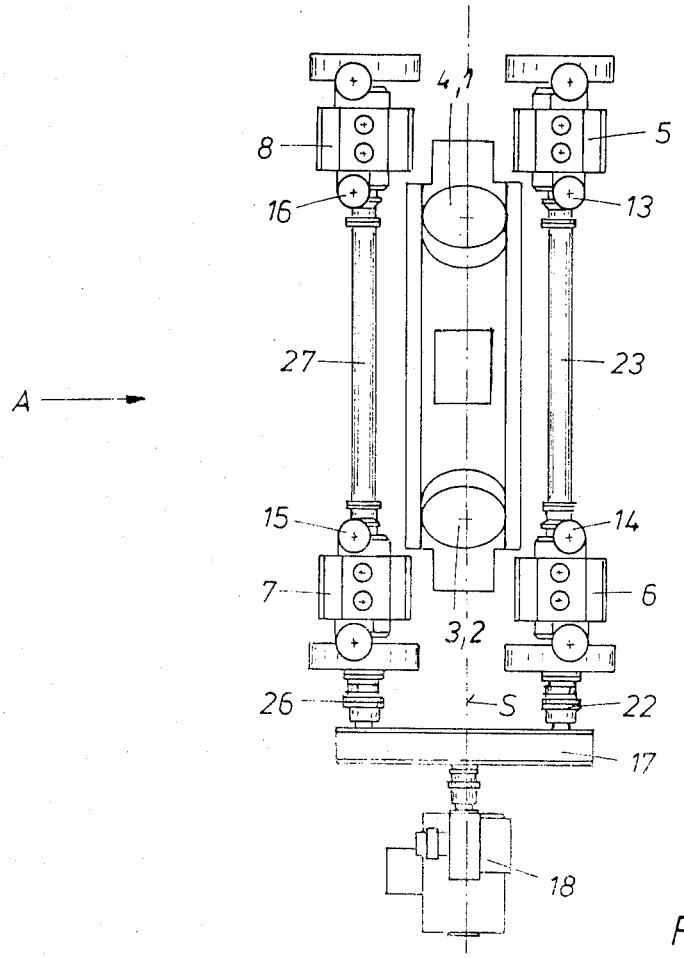
FIG. 2 is a top plan view in reduced size of the arrangement in FIG. 1.

The mechanically synchronized drive for all piston pumps consists of a common drive motor 18 with a power distributing gear unit 17 which comprises (FIG. 1) a centrally positioned spur gear wheel 19 followed toward the right by an intermediate spur gear 20 and an output spur gear 21 with an output shaft 22 which drives the piston pump 6 and which includes an intermediate shaft extension 23 for power transmission to piston pump 5. On the opposite side, the center spur gear wheel 19 meshes with an intermediate spur gear 24 followed by an output spur gear 25 which drives piston pumps 7 and 8 through the output shaft 26 and intermediate shaft 27. The drive motor 18 is located on the vertical center plane S in which the forging axes lie, as shown in FIG. 2. In this manner, the power distributing gear unit 17 with spur gears identical on either side will permit the two output shafts 22, 26 and intermediate shafts 23, 27 to be spaced as required.

I claim:

1. In a hydraulically driven forging machine having four circumferentially spaced working piston-and-cylinder units having central axes on radii lying in a common vertical plane for multidirectional lateral forging of a workpiece disposed in the forging postion therebetween, the forging machine having a horizontal center plane, four synchronously driven fluid pressure-transmitting piston pumps, and separate pipe conduits connecting each piston pump to a respective working cylinder for operating the working piston-and-cylinder units, the improvement comprising:

said piston pumps being individual pumps in upright position arranged about the forging machine; and pump-end pipe connections for respective pipe conduits on said piston pumps all located on the horizontal center plane of the forging machine;

so that said pipe conduits are equal in length and have minimal length for minimizing stroke volume losses in the working piston-and-cylinder units due to compressibility of the fluid pressure medium.

2. The improvement as claimed in claim 1 wherein:

said working piston-and-cylinder units comprise pairs of said units, each unit of a pair being disposed 180° with respect to the other unit of that pair, and the central axes of said units lying on two sloping planes intersecting in the horizontal center plane of the forging machine;

said piston pumps are arranged in pairs on opposite sides of the forging position, the pumps of each pair being on opposite sides of the common vertical plane and adjacent a respective working piston-and-cylinder unit.

* * * * *